US007529508B2

(12) United States Patent
Choi et al.

(10) Patent No.: US 7,529,508 B2
(45) Date of Patent: May 5, 2009

(54) DEVELOPING CARTRIDGE AND ELECTROPHOTOGRAPHIC IMAGE FORMING APPARATUS INCLUDING THE SAME

(75) Inventors: Deug-hyun Choi, Seoul (KR); Sung-gi Kim, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 367 days.

(21) Appl. No.: 11/450,369

(22) Filed: Jun. 12, 2006

(65) Prior Publication Data

US 2007/0048024 A1 Mar. 1, 2007

(30) Foreign Application Priority Data

Aug. 23, 2005 (KR) ..... 10-2005-0077537

(51) Int. Cl.
*G03G 15/08* (2006.01)

(52) U.S. Cl. ..... 399/256; 399/254

(58) Field of Classification Search ..... 399/254, 399/256

See application file for complete search history.

(56) References Cited

U.S. PATENT DOCUMENTS

| | | | | |
|---|---|---|---|---|
| 4,026,241 | A * | 5/1977 | Takebe et al. | 399/256 |
| 6,421,517 | B1 * | 7/2002 | Nishino et al. | 399/254 |
| 7,224,925 | B2 * | 5/2007 | Sato et al. | 399/254 X |

FOREIGN PATENT DOCUMENTS

| | | |
|---|---|---|
| KR | 1998-3928 | 3/1998 |
| KR | 1998-20116 | 6/1998 |
| KR | 2005-37727 | 4/2005 |

* cited by examiner

*Primary Examiner*—Sandra L Brase
(74) *Attorney, Agent, or Firm*—Stanzione & Kim, LLP

(57) ABSTRACT

A developing cartridge includes an agitator including a pair of ribs to effectively force a toner to a center of a flexible agitator film. In the developing cartridge of an electrophotographic image forming apparatus including a housing containing the toner, a developing roller disposed such that a portion thereof is exposed to the housing, and the agitator which is provided in the housing and feeds the toner to the developing roller, the agitator includes a body, the flexible agitating film including a coupling groove and attached to the body, a hook provided on the body and inserted into the coupling groove, and the pair of ribs provided on the body.

17 Claims, 8 Drawing Sheets

DEVELOPING CARTRIDGE AND ELECTROPHOTOGRAPHIC IMAGE FORMING APPARATUS INCLUDING THE SAME

CROSS-REFERENCE TO RELATED APPLICATIONS

This application claims the priority of Korean Patent Application No. 10-2005-0077537, filed on Aug. 23, 2005, in the Korean Intellectual Property Office, the disclosure of which is incorporated herein in its entirety and by reference.

BACKGROUND OF THE INVENTION

1. Field of the Invention

The present general inventive concept relates to a developing cartridge to develop an electrostatic latent image on a photosensitive body and an electrophotographic image forming apparatus including the same.

2. Description of the Related Art

In general, electrophotographic image forming apparatuses form an electrostatic latent image corresponding to a desired image on a photosensitive body by radiating light onto the photosensitive body charged to a uniform potential, develop the electrostatic latent image using a toner to form a toner image, transfer the toner image onto a sheet of paper, and fuse the toner image on the sheet of paper, thereby forming the desired image.

The electrophotographic image forming apparatus includes a developing cartridge. The developing cartridge includes a developing roller facing the photosensitive body and an agitator to feed the toner to the developing roller.

Referring to FIGS. 1 and 2, a conventional agitator includes a body 1 and an agitating film 3. Bosses 2 are provided on one side of the body 1. Coupling holes 4 through which the bosses 2 perforate are provided in the agitating film 3. As illustrated in FIG. 2, the agitating film 3 is inserted into the body 1 such that the bosses 2 perforate through the coupling holes 4 and a heat is then applied to the bosses 2. To this end, portions of the bosses 2 are fused to form fusing portions 6 having a size greater than that of the coupling holes 4. Thus, the agitating film 3 is coupled to the body 1. When the conventional agitator rotates, the agitating film 3 contacts an inner wall 5 of a developing cartridge. One end 3*a* of the agitating film 3 contacting the inner wall 5 of the developing cartridge is curved toward the body 1, as illustrated in FIG. 2. However, a second end 3*b* of the agitating film 3 is curved in an opposite direction of the body 1, as illustrated in FIG. 2. Accordingly, the agitating film 3 may be split. In addition, when the heat is applied to the bosses 2, the agitating film 3 may be damaged by the heat.

FIG. 3 is a view illustrating a conventional agitator. Referring to FIGS. 2 and 3, a reinforcement member 7 made of a material harder than that of the agitating film 3 is attached to the agitating film 3, a heat is applied to the bosses 2, and the agitating film 3 and the reinforcement member 7 are fixed on the body 1. The rienforcement member 7 prevents the agitating film 3 from being damaged by the heat, and supports the other end 3*b* of the agitating film 3 such that the other end 3*b* is prevented from being curved when the conventional agitator rotates. However, since this conventional agitator further requires the reinforcement member 7, a cost of components increases. Also, since a process of assembling the reinforcement member 7 is further required, a production cost increases. Accordingly, prices of the developing cartridge and the image forming apparatus increase.

Recently, price competition of the electrophotographic image forming apparatus has been intensified. Further, when the toner contained in the developing cartridge is used up, the developing cartridge must be replaced. Thus, if the price of the developing cartridge increases, the price competitiveness is reduced.

SUMMARY OF THE INVENTION

The present general inventive concept provides a reliable, cheap developing cartridge including an agitator having an improved structure, and an image forming apparatus including the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a developing cartridge of an electrophotographic image forming apparatus including a housing containing a toner, a developing roller disposed such that a portion thereof is exposed to the housing, and an agitator which is provided in the housing and feeds the toner to the developing roller, wherein the agitator comprises a body, a flexible agitating film including a coupling groove and attached to the body; and a hook provided on the body and inserted into the coupling groove.

The foregoing and/or other aspects and utilities of the present general inventive concept may also be achieved by providing an electrophotographic image forming apparatus including a photosensitive body on which an electrostatic latent image is formed; a housing containing a toner, a developing roller which is disposed such that a portion thereof is exposed to the housing, and feeds the toner to the electrostatic latent image, and an agitator which is provided in the housing and feeds the toner to the developing roller, wherein the agitator comprises a body, a flexible agitating film attached to the body, and including a coupling groove, and a hook provided on the body and inserted into the coupling groove The agitating film may include an adhesive portion attached to the body and an agitating portion to feed the toner toward the developing roller, and the coupling groove may be provided in a portion of the adhesive portion far apart from the agitating portion. The agitator may further include a guide element to guide the toner placed at edges of the housing toward a center of the flexible agitating film. The guide element may include a pair of ribs provided at both sides of the body such that an interval between the ribs is narrower as portions thereof are closer to an opposite side of a rotation direction of the agitator.

The body may include a rotary shaft and an arm which extends from the rotary shaft and has an adhesive surface to which the flexible agitating film is attached, and the hook may be provided on the arm. The flexible agitating film may include an adhesive portion attached to the adhesive surface and an agitating portion to feed the toner toward the developing roller, and the coupling groove may be provided in a portion of the adhesive portion far apart from the agitating portion. A pair of ribs may be provided at both sides of the arm such that an interval between the ribs is narrower as the portions thereof are closer to an opposite side of a rotation direction of the agitator.

The foregoing and/or other aspects and utilities of the present general inventive concept may also be achieved by providing an image forming apparatus, including a housing containing a developing agent, a developing unit to supply the developing agent to a developing unit, and an agitator disposed in the developing unit having a guide unit to guide the developing agent to a center of the agitator.

The foregoing and/or other aspects and utilities of the present general inventive concept may also be achieved by providing a cartridge usable in an image forming apparatus, including a rotating body, one or more arms spaced apart across the rotating body in a direction of a rotational axis of the rotating body, an adhesive surface formed on the one or more arms, and an agitating element provided with an adhesive portion adhering on the adhesive surface.

The foregoing and/or other aspects and utilities of the present general inventive concept may also be achieved by providing a cartridge usable in an image forming apparatus, including a housing containing a developing agent, a developing roller having a portion exposed to the housing, an agitator which is provided in the housing and feeds the developer to the developing roller, the agitator including a rotating body, one or more arms spaced apart across the rotating body in a direction of a rotational axis of the rotating body, an adhesive surface provide on an end of the one or more arms, a flexible agitating film attached to the adhesive surface and having one or more coupling grooves, one or more hooks provided on the adhesive surface and inserted into the coupling grooves, and a guide element provided on the adhesive surface to guide the developing agent toward a center of the agitating film.

The foregoing and/or other aspects and utilities of the present general inventive concept may also be achieved by providing a toner agitation apparatus, including a rotating body having at least one arm and one end of the at least one arm connecting to the rotating body, an adhesive surface connected to a second end of that at least one arm, a plurality of hooks provided on the adhesive surface, an agitation film having an adhesive portion to connect to the adhesive surface, an agitating portion to agitate the toner as the rotating body rotates, and a plurality of coupling grooves to connect with the plurality of hooks.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
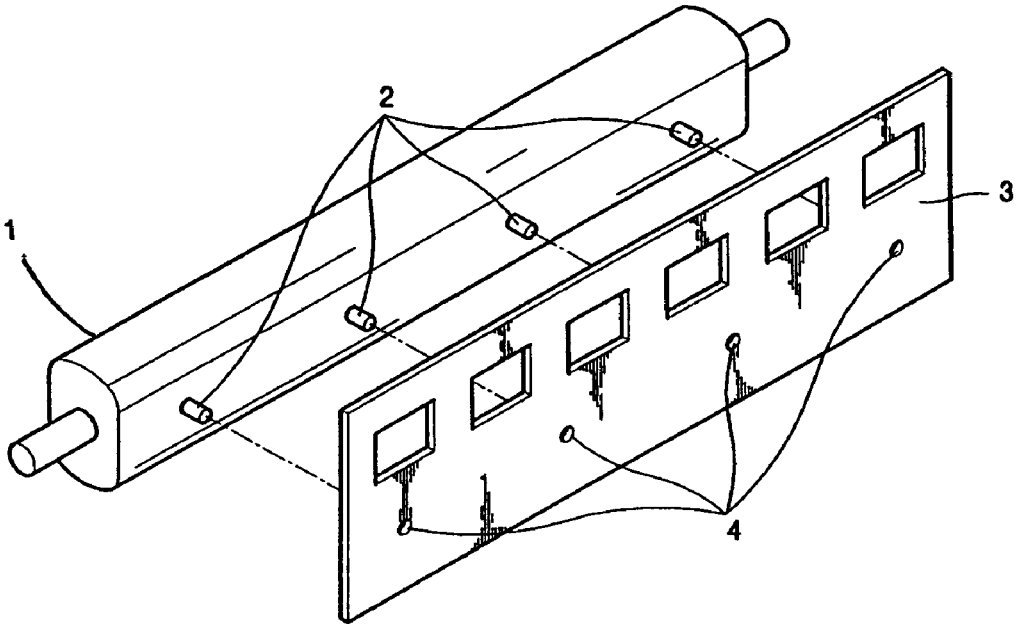
FIG. 1 (PRIOR ART)
FIG. 1 is an exploded perspective view illustrating a conventional agitator.
Figure 2:
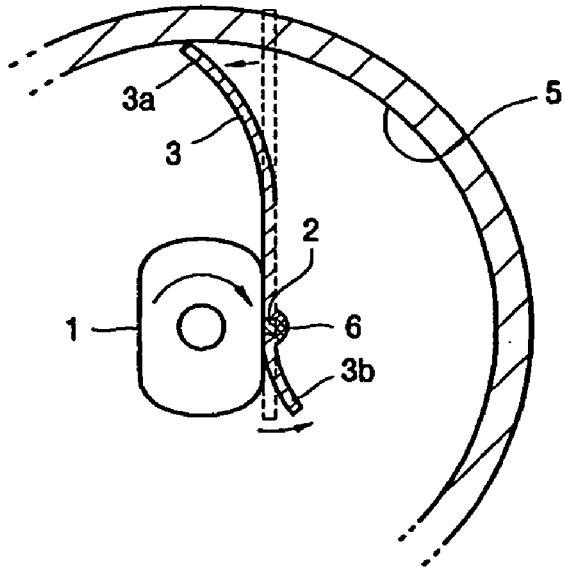
FIG. 2 (PRIOR ART)
FIG. 2 is a side view illustrating the conventional agitator of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
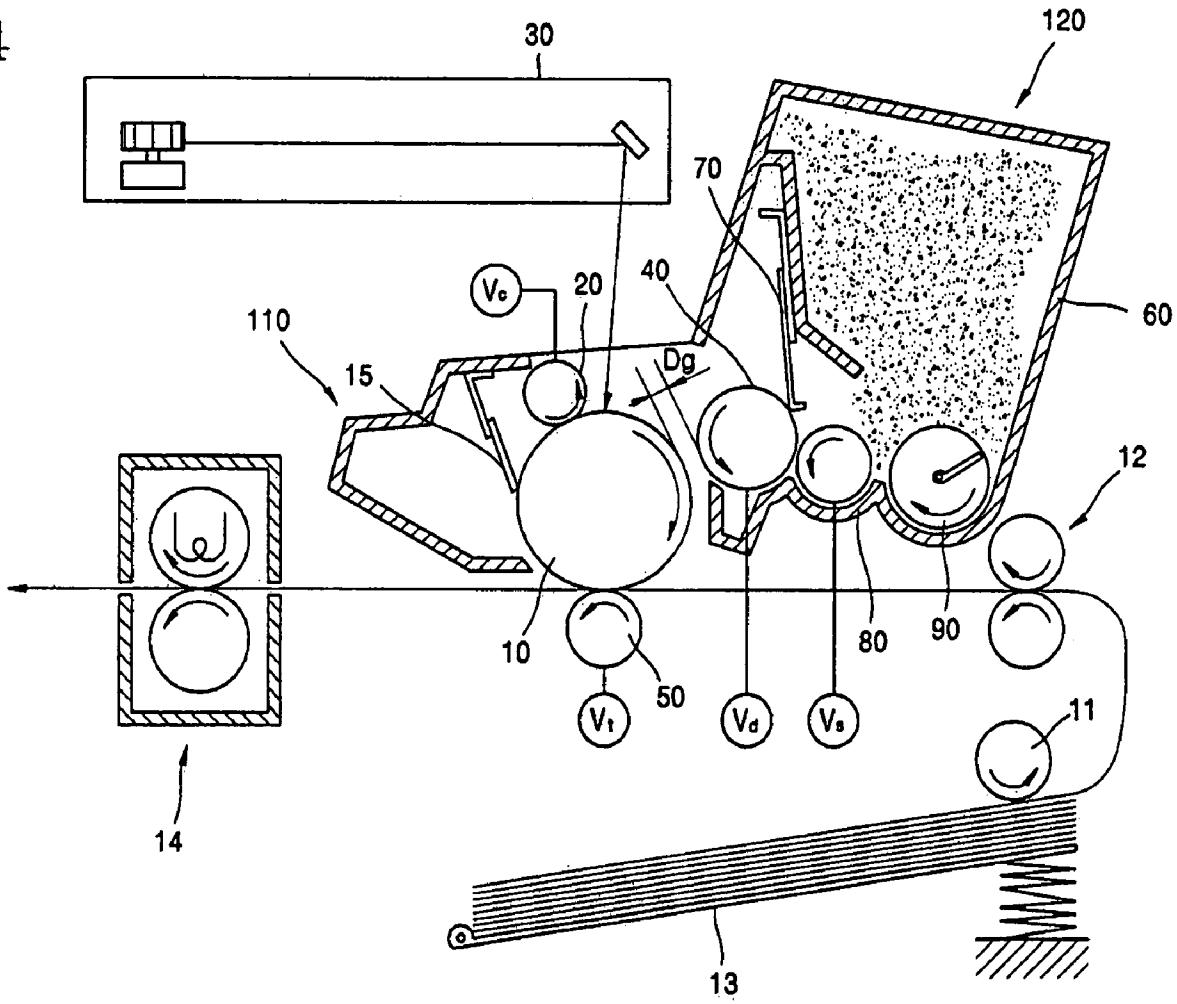
FIG. 4 is a view illustrating an electrophotographic image forming apparatus according to an embodiment of the present general inventive concept.

FIG. 4 illustrates an electrophotographic image forming apparatus according to an embodiment of the present general inventive concept. Referring to FIG. 4, the electrophotographic image forming apparatus include a photosensitive drum 10, a charging roller 20, an exposure unit 30, a developing roller 40, and a transfer roller 50.

The photosensitive drum 10 is an example of a photosensitive body in which a photosensitive layer having a predetermined thickness is formed on an outer circumferential surface of a cylindrical metal pipe. A photosensitive belt may be employed as the photosensitive body.

The charging roller 20 charges a surface of the photosensitive drum 10 to a uniform potential while rotating in contact with the photosensitive drum 10. A charging bias Vc is applied to the charging roller 20. Instead of the charging roller 20, a corona charger (not shown) may be used.

The exposure unit 30 irradiates a light corresponding to image information onto the photosensitive drum 10 charged to the unfirm potential to form an electrostatic latent image on the photosenstive drum 10. A laser scanning unit using a laser diode as a light source is used as the exposure unit 30.

A portion of the developing roller 40 is exposed from a housing 60 containing a toner to an outside of the housing 60 to face the photosensitive drum 10. The developing roller 40 rotates while facing the photosensitive drum 10. A development bias Vd is applied to the developing roller 40. The toner contained in the housing 60 is attached to a surface of the developing roller 40, moved to a developing nip between the photosensitive drum 10 and the developing roller 40, and attached to the electrostatic latent image on the photosensitive drum 10 by the development bias Vd. Reference numeral 70 refers to a control member to control an amount of the toner adhering to the surface of the developing roller 40. Reference numerals 80 and 90 denote a feeding roller to feed the toner contained in the housing 60 to the developing roller 40 and an agitator, respectively. A feeding bias Vs may be applied to the feeding roller 80 to attach the toner to the developing roller 40. The image forming apparatus according to the present embodiment employs a non-contact developing manner. In the non-contact developing manner, the developing roller 40 is spaced apart from the photosensitive drum 10 by a development gap Dg. The image forming apparatus may employ a contact developing manner in which the developing roller 40 contacts the photosensitive drum 10.

The transfer roller 50 faces the photosensitive drum 10 to form a transfer nip. A transfer bias Vt for transferring a toner image adhering to the photosensitive drum 10 onto a sheet of paper is applied to the transfer roller 50. Instead of the transfer roller 50, a corona transfer unit may be used. Reference numeral 15 denotes a cleaning blade to remove the toner remaining on the surface of the photosensitive drum 10.

Reference numerals 110 and 120 denote a photosensitive unit 110 and a developing unit 120, respectively. A developing cartridge may represent only the developing unit 120 or a combination of the photosensitive unit 110 and the developing unit 120. That is, the housing 60 may have a structure to include the developing unit 120 and/or the photosensitive unit 110.

When a print instruction is delivered from a host computer (not shown) to the image forming apparatus, the charging bias Vc is applied to the charging roller 20 and the photosensitive drum 10 is charged to the uniform potential. The exposure unit 30 irradiates a modulated light corresponding to the image information onto the photosensitive drum 10. A resistance of a portion of the photosensitive drum 10 onto which the light is irradiated is reduced since charges on an outer circumferential surface of the photosensitive drum 10 corresponding to the irradiated portion escape due to the irradiated light. Thus, a potential difference is generated between the light irradiated portion and a non-irradiated portion, thereby forming the electrostatic latent image on the outer circumferential surface of the photosensitive drum 10. The development bias Vd is applied to the developing roller 40. A charged toner on the developing roller 40 traverses the development gap Dg by the development bias Vd and is attached to the electrostatic latent image. Thus, the toner image is formed on the photosensitive drum 10. When the photosensitive drum 10 rotates, the toner image enters into the transfer nip. The sheet of paper fed from a loading member 13 by a pickup roller 11 is conveyed to the transfer nip by a conveying roller 12. The transfer bias Vt is applied to the transfer roller 50. The toner image is transferred onto the sheet of paper by an electrostatic force of the transfer bias Vt. The toner image transferred onto the sheet of paper is fused on the sheet of paper by heat and a pressure applied by a fixing unit 14, thereby forming a printed image.

Figure 5:
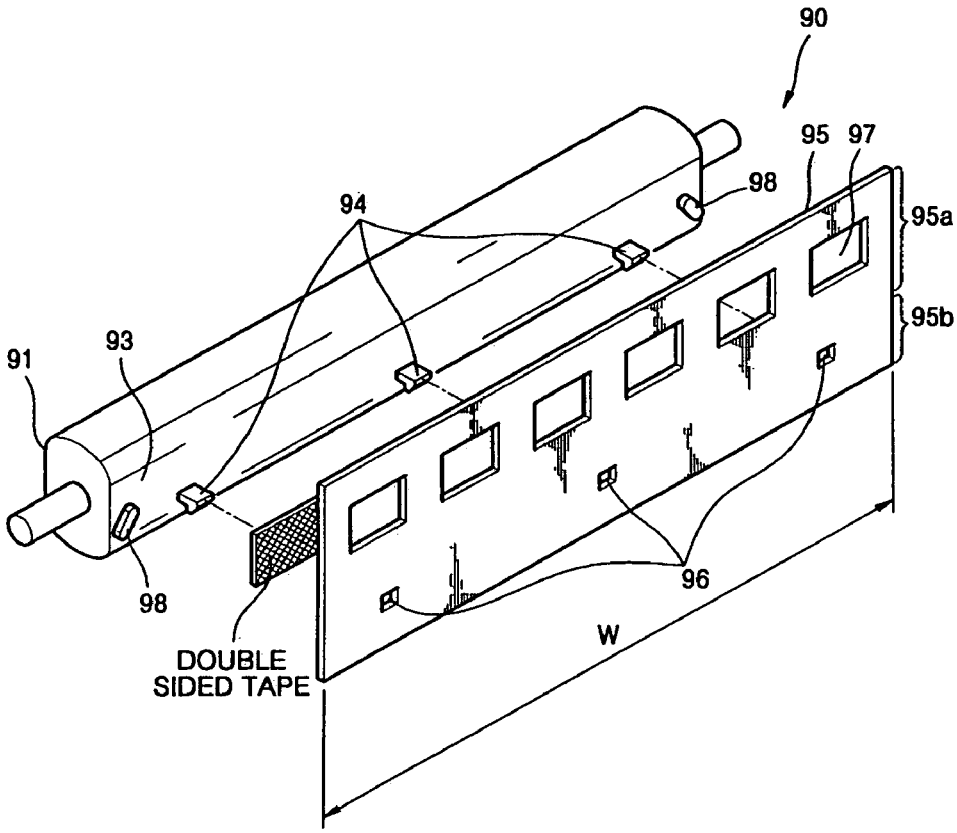
FIG. 5 is an exploded perspective view illustrating an agitator according to an embodiment of the present general inventive concept.

The agitator 90 conveys the toner contained in the housing 60 toward the developing roller 40 and/or the developing roller 80 and charges the toner. In FIG. 5, the agitator 90 according to an embodiment of the present general inventive concept includes a body 91 and a agitating film 95. The body 91 may be referred to as a rotating body and an agitator body. The agitating film 95 may be referred to as a flexible agitating film. Coupling grooves 96 are provided in the agitating film 95. The body 91 has an adhesive surface 93. Hooks 94 are formed on a portion of the adhesive surface 93 to be inserted into the coupling grooves 96. The agitating film 95 includes an adhesive portion 95*b* facing the adhesive surface 93 of the body 91 and an agitating portion 95*a* to feed the toner toward the developing roller 40. A plurality of perforated holes 97 are formed on the agitating portion 95*a* to reduce a resistance generated when the toner is pushed by the agitating film 95. For example a double sided tape may be attached to the adhesive portion 95*b* of the agitating film 95. The agitating film 95 is coupled to the body 91 such that the hooks 94 are inserted into the coupling grooves 96 and the adhesive portion 95*b* is pressed and attached to the adhesive surface 93 of the body 91.

Figure 6:
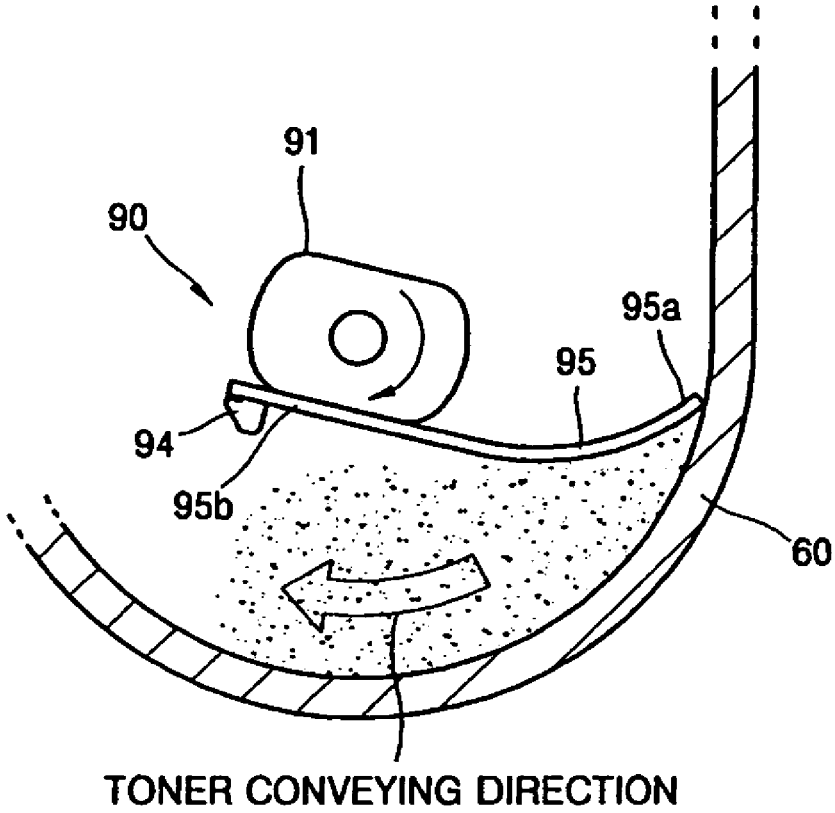
FIG. 6 illustrates an operation of the agitator of FIG. 5.

As illustrated in FIG. 6, when the agitating portion 95*a* is curved by contact with an inner wall of the housing 60, a force is applied to the adhesive portion 95*b* such that the adhesive portion 95*b* is separated from the adhesive surface 93 by an elasticity of the agitating film 95. However, since the hooks 94 are coupled to the coupling grooves 96, the adhesive portion 95*b* can be prevented from being separated from the adhesive surface 93. The hooks 94 include a distal end and a bent part extended from the body 91 and bent toward a direction opposite to the agitating portion 95*a* with respect to the adhesive part in 95*b* or a direction corresponding to the rotation direction of the agitator 90, that is, a direction from the agitating portion 95*a* to the adhesive portion 95*b* such that the distal end of the hooks 94 holds the agitating film 95 in a direction opposite to a resistance direction between the agitating film 95 and the inner wall of the housing 60. The coupling grooves 96 may be provided in portions of the adhesive portion 95*b* far apart from the agitating portion 95*a*. An area of the inner wall of the housing 60 contacted by the agitating portion 95*a* may be referred to as an agitator contact area.

Figure 3:
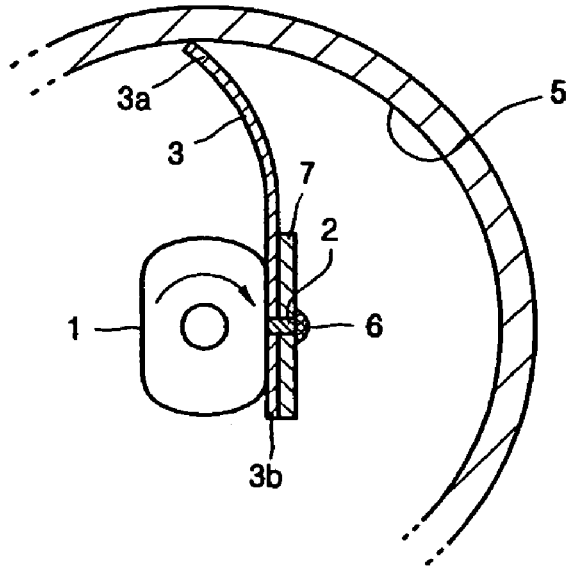
FIG. 3 (PRIOR ART)
FIG. 3 is a side view illustrating another conventional agitator.

In the present embodiment, a process of fabricating the agitator 90 is simpler than a conventional process of fabricating the agitator which requires a heat fusing process, and a production cost can be reduced. Also, since an adhesive strength of the agitating film 95 can be maintained using the hooks 94 integrally provided on the body 91, the conventional reinforcement member (7 of FIG. 3) is unnecessary and thus a cost of components can be reduced, and a reliable agitator can be realized.

Referring to FIG. 5, a pair of ribs 98 is provided on both sides of the body 91. The pair of ribs 98 is an example of a guide element to guide the toner placed at edges of the housing 60 toward a center of a width direction of the agitating film 95. A width W of the agitating film 95 may be greater than that of the printed image. In addition, a width of the housing 60 may also be greater than a width of the body 91 on which the agitating film 95 is provided. An axis of rotation of the body 91 may be in the width direction of housing 60, and the body 91 is placed to rotate against each inner wall of the housing 60 with respect to the width direction of the housing 60. Thus, the width of the housing 60 is greater than the width W of the agitating film 95. Accordingly, the toner between both edges of the agitating film 95 and each inner wall in the width direction of the housing 60 may be efficiently used for a development of the toner image using at least one of the pair of ribs 98. The pair of ribs 98 is provided such that an interval between the ribs 98 is narrower as portions thereof are closer to an opposite side of a rotation direction of the agitator 90. That is, first ends of the ribs 98 have a distance greater than that of second ends of the ribs 98 with respect to the rotation axis of the body 91. The ribs 98 have an angle of less that 90 degrees with respect to the rotational direction of the body 91. When the agitator 90 rotates, the toner between the both edges of the agitating film 95 and each inner wall in the width direction of the housing 60 is guided toward the center of the agitating film 95 by the pair of ribs 98. Accordingly, a ratio of the toner which can be efficiently used for the development of the toner image to the toner contained in the developing cartridge can increase. Since the developing cartridge must be replaced when a contained toner is used up, a cost of consumables is reduced by providing a guide element, such as the ribs 98.

Figure 7:
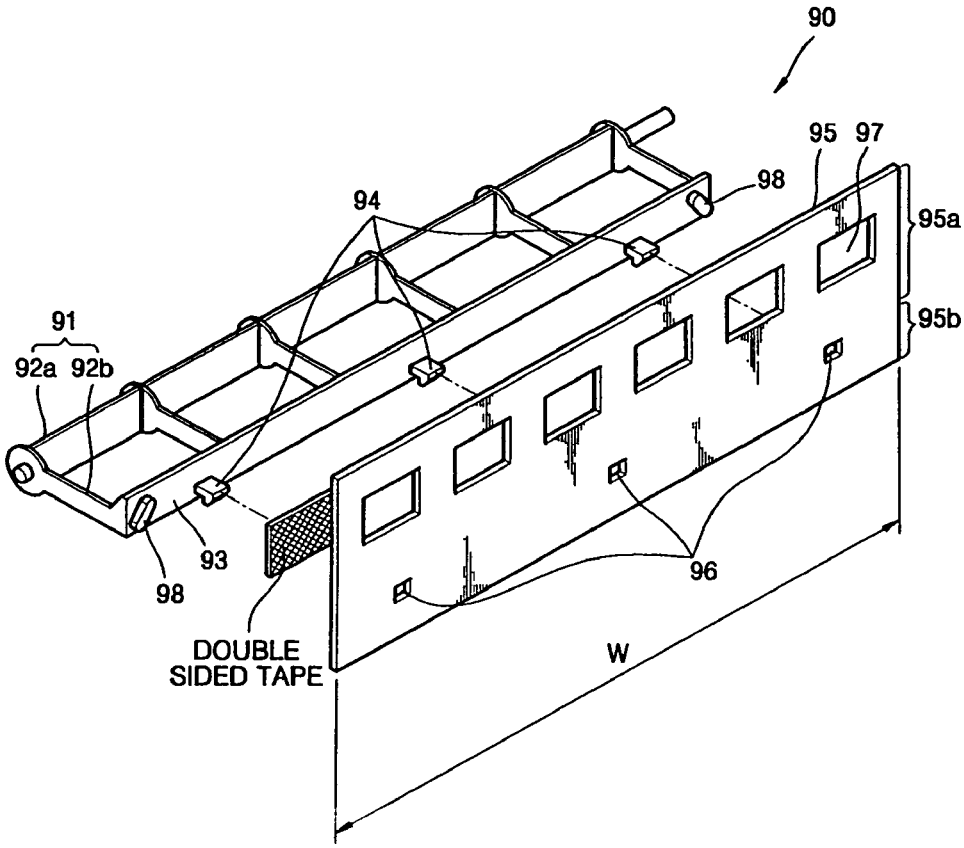
FIG. 7 is an exploded perspective view illustrating an agitator according to an embodiment of the present general inventive concept.
Figure 8:
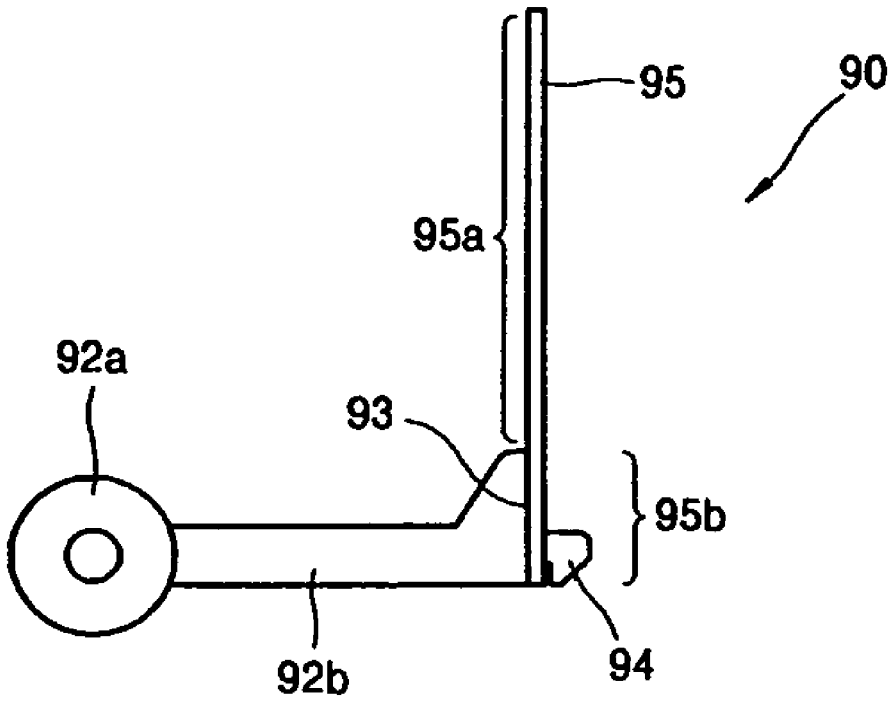
FIG. 8 is a side view illustrating the agitator of FIG. 7.
Figure 9:
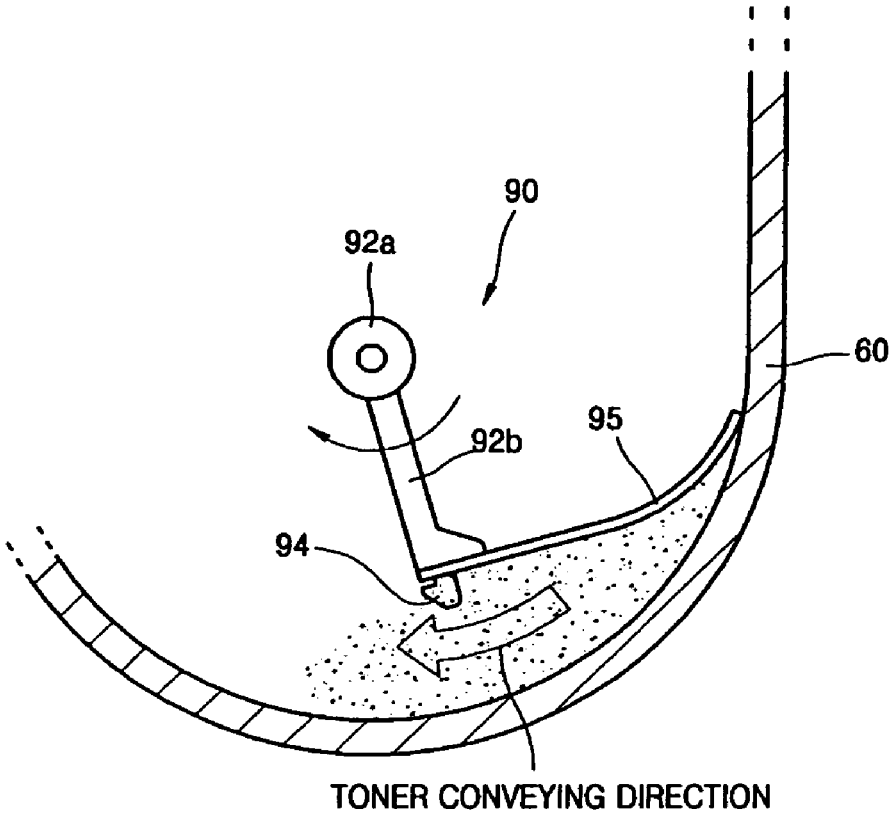
FIG. 9 illustrates an operation of the agitator of FIG. 7.

FIGS. 7 and 8 are an exploded perspective view and a side view illustrating an agitator 90 according to another embodiment of the present general inventive concept, respectively. Referring to FIGS. 4, 7 and 8, the body 91 of the agitator 90 includes a rotary shaft 92*a* and at least one arm 92*b*. One end of the at least one arm 92*b* extends from the rotary shaft 92*a* and the second end of the at least one arm 92*b* is connected to the adhesive surface 93. The arms 92*b* are spaced apart from one another along the rotational axis. The hooks 94 are provided on the adhesive surface 93. An agitating film 95 is coupled to the adhesive surface 93 such that the hooks 94 are inserted into coupling grooves 96 and an adhesive portion 95*b* is pressed and attached to the adhesive surface 93 of the arm 92*b*. The pair of ribs 98 is provided on both sides of the adhesive surface 93. The pair of ribs 98 is an example of the guide element to guide the toner disposed at the edges of the housing 60 toward the center of the width direction of the agitating film 95. The pair of ribs 98 is provided such that the interval between the ribs 98 is narrower as the portions thereof are closer to the opposite side of the rotation direction of the agitator 90. The ribs 98 are inclined with respect to a rotational direction of the rotary shaft 92*a* to guide the toner from a side wall of the housing to an inside wall of housing. As illustrated in FIG. 9, when the agitator 90 rotates, the agitating film 95 conveys the toner in the housing 60 toward the developing roller 40 (illustrated in FIG. 4). By this embodiment, the same effect as the embodiment illustrated in FIGS. 5 and 6 can be obtained. The adhesive portion 95*b* may be attached to the adhesive surface 93 by a double sided tape as illustrated in FIGS. 5 and 7. Thus a first side of the double sided tape adheres to the adhesive surface 93 and a second side of the double sided tape adheres to the adhesive portion 95*b*. The double sided tape may extend along the width W of the agitating film 95. The double sided tape may be placed along the hooks 98 or be pierced by the hooks 98. In addition, the double sided tape may be cut to fit in a space between each of the hooks 98.

Figure 10:
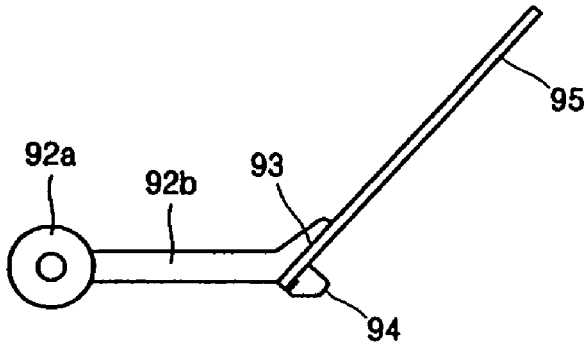
FIG. 10 is a side view illustrating an agitator according to an embodiment of the present general inventive concept.

The agitator 90 must feed to the developing roller 40 more toner than that to be consumed by the developing roller 40 during a developing process. If a toner conveying force of the agitator 90 is excessive, the toner applies an excessive pressure to the developing roller 40 and the feeding roller 80 such that a development performance may be deteriorated or the toner may be leaked to an outside of the housing 60. Referring to FIG. 10, an angle of the agitator 90 to push the toner may be adjusted by adjusting a slope of the adhesive surface 93 provided on the end of the at least one arm 92*b*. The arm 92*b* may form an angle greater than 90 degrees with a main portion of the agitating film 95, and the main portion of the agitating film 95 may be the adhesive portion 95*b* of the agitating film 95. According to the embodiment of the agitator 90 illustrated in FIGS. 7 through 9, since the adhesive surface 93 is provided on the end of the arm 92*b* which extends from the rotary shaft 92*a*, the slope of the adhesive surface 93 can be adjusted in a wider range, compared to the agitator 90 illustrated in FIGS. 5 and 6. Accordingly, the toner conveying force of the agitator 90 can be easily adjusted in an adequate range to obtain a good development performance.

As described above, the developing cartridge and the electrophotographic image forming apparatus according to the present general inventive concept can simplify a fabricating process over the conventional process which requires the heat fusing process, and the reliable agitator may be realized without the reinforcement member. Accordingly, prices of the developing cartridge and the image forming apparatus can be reduced.

Furthermore, a ratio of the toner can be efficiently used for the development of the toner image of the toner contained in the developing cartridge can. Accordingly, a cost of consumables can be reduced.

Accordingly, a characteristic deterioration of the toner and the components of the developing unit can be minimized, a variation of the consumed amount of the toner applied to a print sheet can be reduced, the consumed amount of the toner can be reduced to extend a lifespan of the developing cartridge, and print quality of an image can be improved.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing cartridge of an electrophotographic image forming apparatus, comprising:

a housing containing a toner;

a developing roller disposed such that a portion thereof is exposed to the housing; and an agitator which is provided in the housing and feeds the toner to the developing roller, the agitator comprising:

a body, a flexible agitating film attached to the body and comprising a coupling groove, a hook provided on the body and inserted into the coupling groove, and a guide element to guide the toner placed at edges of the housing toward a center of the flexible agitating film, wherein the guide element comprises a pair of ribs provided at both sides of the body such that an interval between the ribs is narrower as portions thereof are closer to a direction opposite to a rotation direction of the agitator.

2. The developing cartridge according to claim 1, wherein the flexible agitating film comprises an adhesive portion attached to the body, an agitating portion to feed the toner toward the developing roller, and the coupling groove provided in a portion of the adhesive portion far apart from the agitating portion.

3. The developing cartridge according to claim 1, wherein the body comprises a rotary shaft and an arm which extends from the rotary shaft and has an adhesive surface to which the flexible agitating film is attached, and the hook provided on the arm.

4. The developing cartridge according to claim 3, wherein the flexible agitating film comprises an adhesive portion attached to the adhesive surface and an agitating portion to feed the toner toward the developing roller, and the coupling groove is provided in a portion of the adhesive portion far apart from the agitating portion.

5. The developing cartridge according to claim 4, wherein the agitator comprises a pair of ribs provided at both sides of the arm such that an interval between the ribs is narrower as the portions thereof are closer to an opposite side of a rotation direction of the agitator.

6. An electrophotographic image forming apparatus, comprising:

a photosensitive body on which an electrostatic latent image is formed;

a housing containing a toner;

a developing roller which is disposed such that a portion thereof is exposed to the housing, and feeds the toner to the electrostatic latent image; and an agitator which is provided in the housing and feeds the toner to the developing roller, the agitator comprising:

a body, a flexible agitating film attached to the body and comprising a coupling groove, a hook provided on the body and inserted into the coupling groove, and a guide element to guide the toner placed at edges of the housing toward a center of the flexible agitating film, wherein the guide element comprises a pair of ribs provided at both sides of the body such that an interval between the ribs is narrower as portions thereof are closer to an opposite side of a rotation direction of the agitator.

7. The electrophotographic image forming apparatus according to claim 6, wherein the flexible agitating film comprises an adhesive portion attached to the body, an agitating portion to feed the toner toward the developing roller, and the coupling groove provided in a portion of the adhesive portion far apart from the agitating portion.

8. The electrophotographic image forming apparatus according to claim 6, wherein the body comprises a rotary shaft and an arm which extends from the rotary shaft and has an adhesive surface to which the flexible agitating film is attached, and the hook is provided on the arm.

9. The electrophotographic image forming apparatus according to claim 8, wherein the agitating film comprises an adhesive portion attached to the adhesive surface and an agitating portion to feed the toner toward the developing roller, and the coupling groove is provided in a portion of the adhesive portion far apart from the agitating portion.

10. The electrophotographic image forming apparatus according to claim 9, wherein the agitator comprises a pair of ribs at both sides of the arm such that an interval between the ribs is narrower as the portions thereof are closer to an opposite side of a rotation direction of the agitator.

11. The electrographic image forming apparatus according to claim 9, further comprising:

a double sided tape to adhere the adhesive portion to the adhesive surface.

12. An image forming apparatus, comprising:

a unit to feed a medium;

a developing cartridge comprising:

a housing containing a developing agent;

a developing roller to supply the developing agent to a photosensitive body; and an agitator disposed in the n housing to feed the developing agent to the developing roller, and having a guide element to guide the developing agent in a rotation axis direction of the agitator, and a unit to form an image on the medium using the developing agent of the developing cartridge, wherein the guide element comprises a pair of ribs provided at both sides of the agitator such that an interval between the ribs is narrower as portions thereof are closer to a direction opposite to a rotation direction of the agitator.

13. A cartridge usable in an image forming apparatus, comprising:

a housing containing a developing agent;

a developing roller having a portion exposed to the housing;

an agitator which is provided in the housing to feed the developing agent to the developing roller, and having a guide element to guide the developing agent in a rotation axis direction of the agitator, wherein the guide element comprises a pair of ribs provided at both sides of the body such that an interval between the ribs is narrower as portions thereof are closer to a direction opposite to a rotation direction of the agitator.

14. The cartridge of claim 13, wherein the agitator further comprises:

a rotating body;

a flexible agitating film to agitate the developing agent; and one or more hooks formed on the rotating body to connect the flexible agitating film to the rotating body.

15. The cartridge of claim 14, wherein the rotating body comprises an adhesive surface to be attached to the flexible agitating film to form an angle with the flexible agitating film.

16. The cartridge of claim 14, wherein the one or more hooks comprise a portion formed on the rotating body and a second portion bent from the portion toward a rotational direction of the rotating body.

17. The cartridge of claim 14, wherein the rotating body comprises a rotating shaft, a surface portion attached to the flexible agitating film, and a plurality of arms formed between the rotating shaft and the surface portion which are spaced apart from each other.

* * * * *